US006098498A

United States Patent [19]

Ming et al.

[11] Patent Number: 6,098,498

[45] Date of Patent: Aug. 8, 2000

[54] SEAT FOR GUIDING SCREWS AND NAILS

[76] Inventors: Jang Chau Ming; Po-Chuan Chen; Po-Shen Chen; Chuang Chang Chi, all of P.O. Box 82-144, Taipei, Taiwan

[21] Appl. No.: 09/086,350

[22] Filed: May 29, 1998

[51] Int. Cl.[7] ..... B25C 3/00

[52] U.S. Cl. ..... 81/44; 81/421; 269/279

[58] Field of Search ..... 81/44, 487, 180.1, 81/185.1, 421, 178; 269/271, 279, 280, 283; D19/73

[56] References Cited

U.S. PATENT DOCUMENTS

| | | | |
|---|---|---|---|
| D. 146,197 | 1/1947 | Staab | D19/73 |
| D. 251,977 | 5/1979 | Leuenberger et al. | D19/73 |
| D. 254,858 | 4/1980 | Mobius | D19/73 |
| 1,205,149 | 11/1916 | Bovee | 81/178 |
| 1,262,621 | 4/1918 | Beacham | 269/279 |
| 1,321,208 | 11/1919 | Hinnershitz | 269/279 |
| 1,330,514 | 2/1920 | Brooks | 81/487 |
| 2,404,224 | 7/1946 | Fink | 81/421 |
| 4,079,765 | 3/1978 | Hatayam | 81/44 |
| 4,201,258 | 5/1980 | Elmore et al. | 81/44 |
| 4,905,550 | 3/1990 | Albrecht | 81/185.1 |

FOREIGN PATENT DOCUMENTS

| | | | |
|---|---|---|---|
| 231754 | 8/1944 | Switzerland | 81/44 |

*Primary Examiner*—David A. Scherbel
*Assistant Examiner*—Joni B. Danganan
*Attorney, Agent, or Firm*—A & J

[57] ABSTRACT

A seat for guiding screws and nails includes a block having two opposite vertical lateral sides and two opposite ends, each of the sides being formed with a plurality of semi-circular holes, and a rectangular opening extending through the two opposite ends, whereby a jaw of a longnose pliers may be inserted into the rectangular opening of the trapezium block to keep the trapezium block at a fixed position thereby enabling a screw or the like to be guided safely, rapidly and accurately by the vertical passage between the semi-circular hole and another jaw of the longnose pliers to a workpiece.

4 Claims, 6 Drawing Sheets

SEAT FOR GUIDING SCREWS AND NAILS

BACKGROUND OF THE INVENTION

1. Field of the Invention

This invention is related to a seat and in particular to one for guiding screws and nails.

2. Description of the Prior Art

When desired to force a nail or screw into a workpiece, a pair of longnose pliers 4 are used for holding and guiding the screw or nail between two jaws 41 to a workpiece 5. Although the pliers can prevent the user's hand from getting injuried, such expedient still suffers from the following drawbacks:

1. The screw or nail cannot be firmly held by the pliers when the pliers are used as a guide, so that the screw or nail cannot be kept at a vertical position thereby making it very difficult to force the screw or nail vertically into a workpiece.
2. As the screw or nail cannot be firmly held by the pliers, the user must concentrate his mind in the operation thus putting a heavy burden on his spirit and body.

Therefore, it is an object of the present invention to provide a seat for guiding screws and nails which can obviate and mitigate the above-mentioned drawbacks.

SUMMARY OF THE INVENTION

This invention is related to a seat for guiding screws and nails.

It is the primary object of the present invention to provide a seat which can be used for guiding screws and nails safely, rapidly and accurately to a workpiece.

It is another object of the present invention to provide a seat for guiding screws and nails which is simple in construction.

It is still another object of the present invention to provide a seat for guiding screws and nails which is low in cost.

It is still another object of the present invention to provide a seat for guiding screws and nails which is easy to use.

It is a further object of the present invention to provide a seat for guiding screws and nails which is fit for practical use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1A:
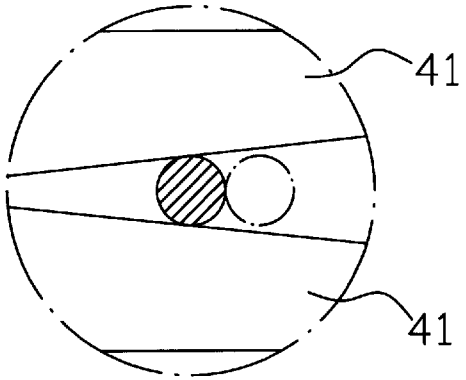
(PRIOR ART) FIG. 1A
FIG. 1A is an enlarged top view of a portion of FIG. 1.
Figure 1:
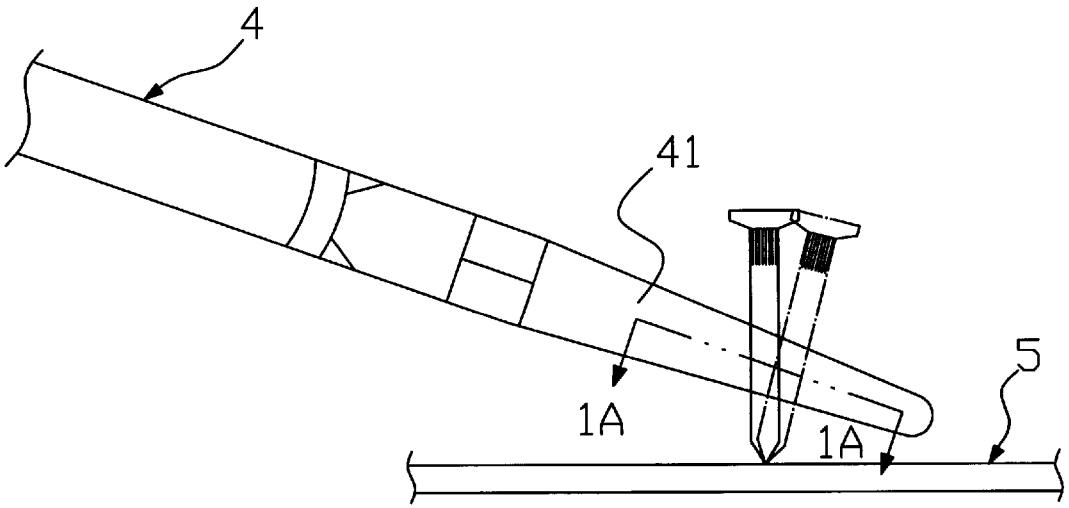
(PRIOR ART) FIG. 1
FIG. 1 illustrate the conventional way to guide a screw.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
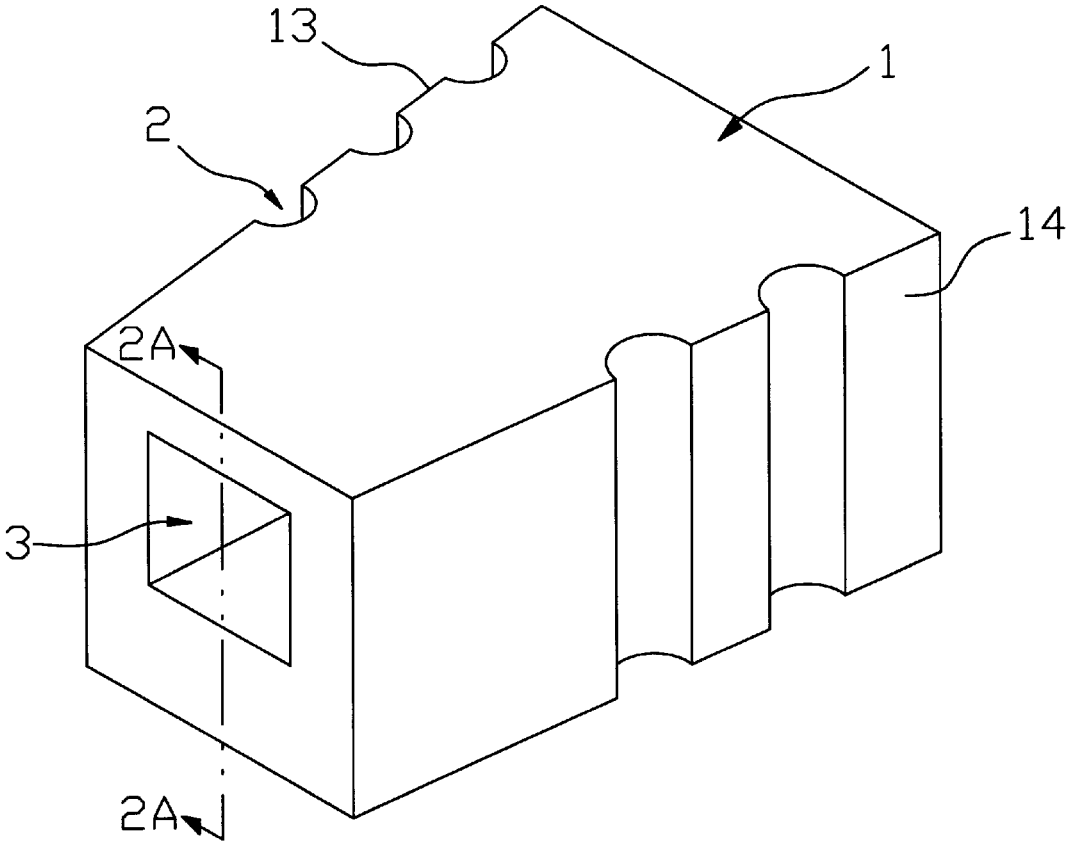
FIG. 2 is a perspective view of the present invention.
Figure 2A:
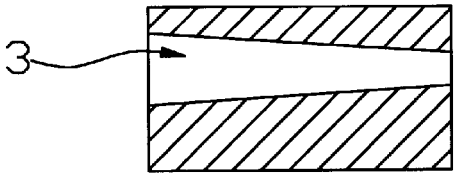
FIG. 2A is a reduced sectional view of the present invention.
Figure 3:
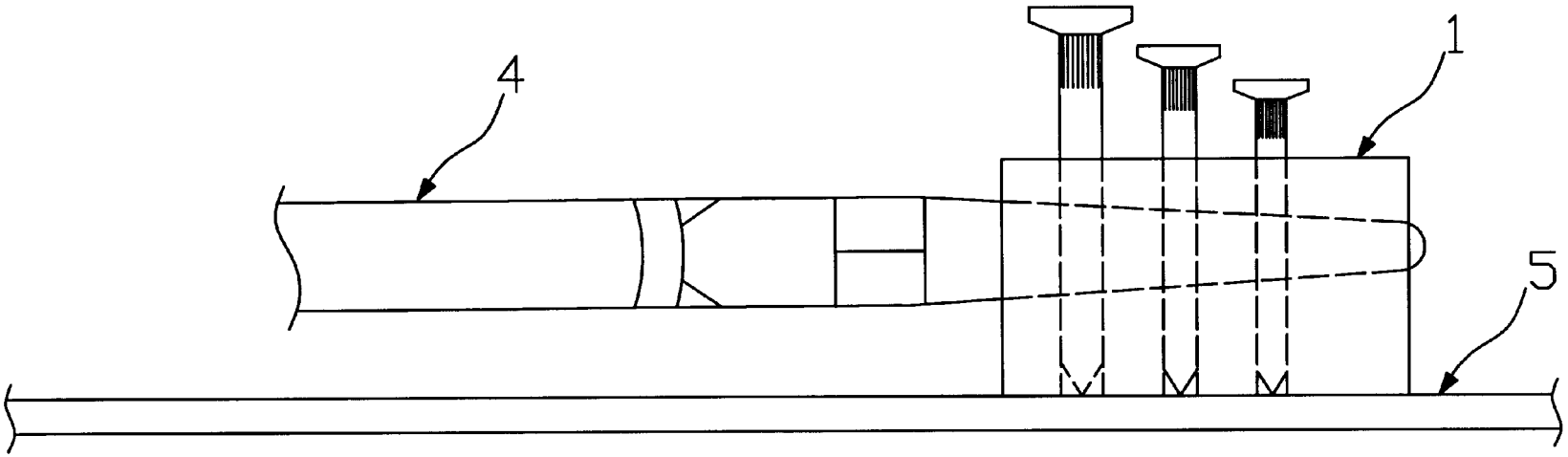
FIG. 3 is a working view of the present invention.
Figure 4:
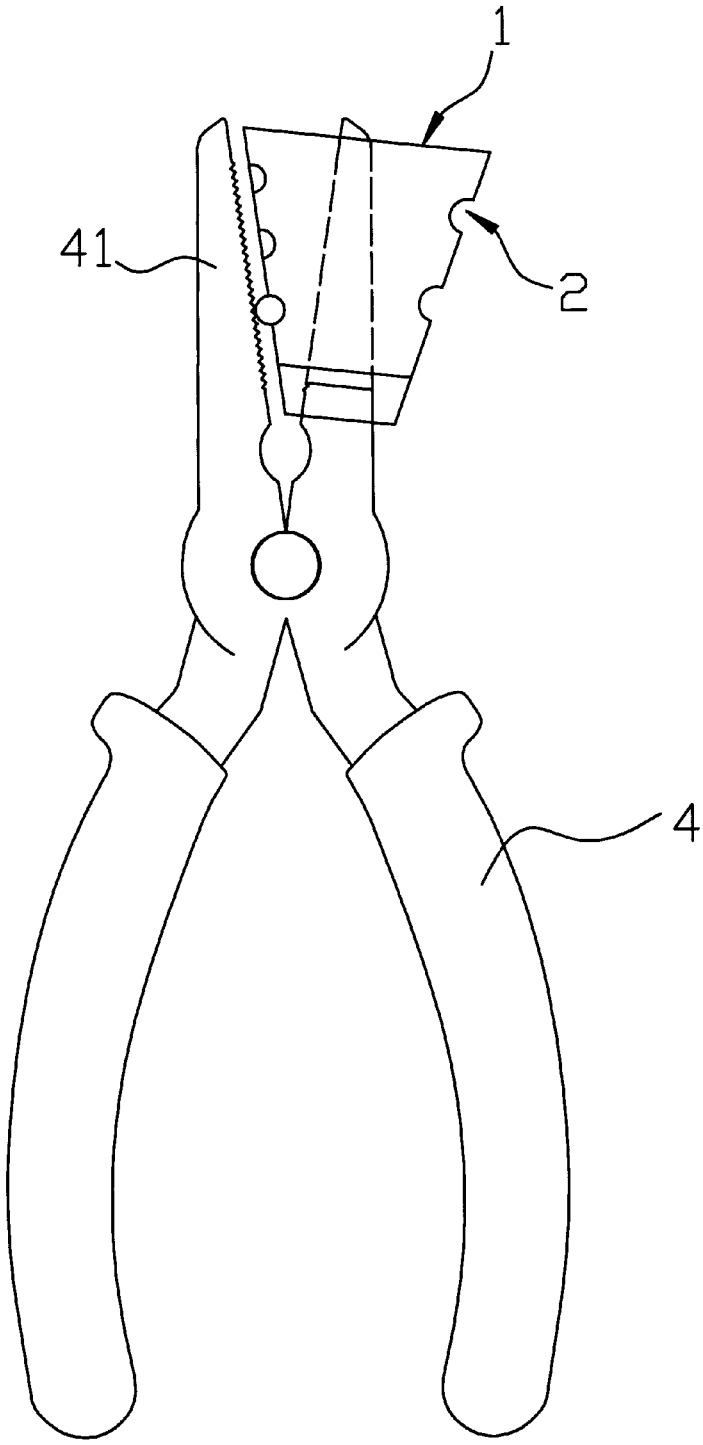
FIG. 4 is another working view of the present invention.

With reference to the drawings and in particular to FIGS. 2, 3 and 4 thereof, the seat according to the present invention comprises a block 1 which is formed with three vertical semi-circular holes 2 with different diameters on the left side 13 and two vertical semi-circular holes 2 with different diameters on the right side 14. As shown in FIG. 2A, the block 1 is further formed with a rectangular opening 3 extending through both ends of the block 1 for the passage of the jaw 41 of a pair of longnose pliers 4 (see FIGS. 2A, 3 and 4).

Figure 5:
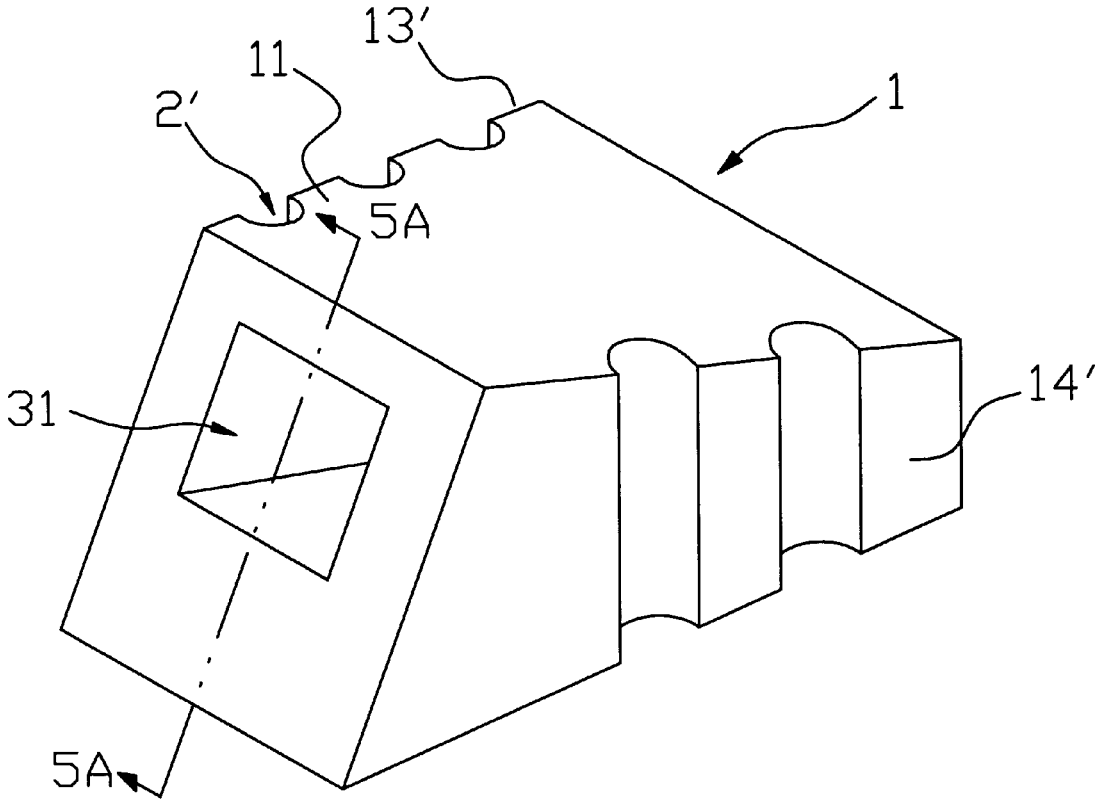
FIG. 5 is a perspective view of a second preferred embodiment of the present invention.
Figure 5A:
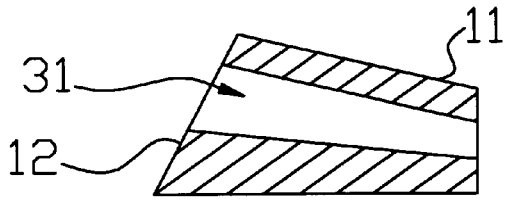
FIG. 5A is a reduced sectional view of the second preferred embodiment of the present invention.
Figure 6:
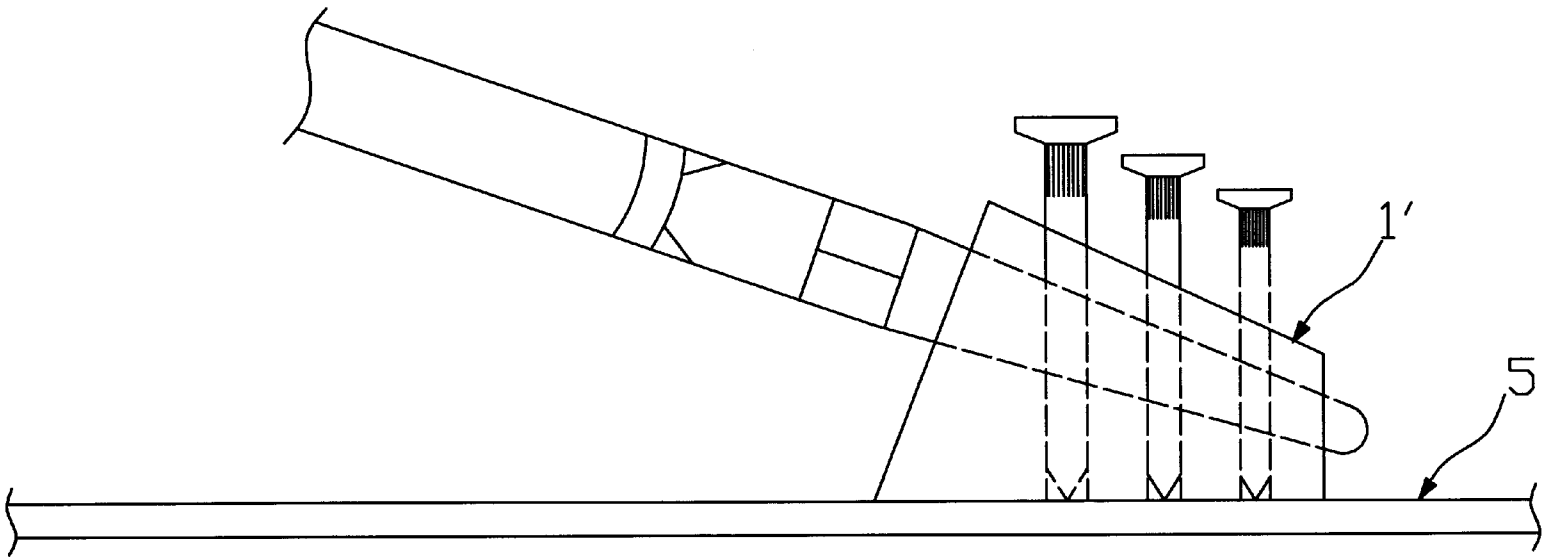
FIG. 6 is a working view of the second preferred embodiment of the present invention.

FIGS. 5 and 5A illustrate a second preferred embodiment of the present invention. As shown, the block 1' is formed with an inclined top 11 and an inclined end 12. The two opposite ends of the block 1' may be each formed with an inclined surface. The block 1' is formed with three vertical semi-circular holes 2' with different diameters at the left side 13' and two vertical semi-circular holes 2' at the right side 14'. As shown in FIG. 6, the block 1' is formed with a rectangular opening 31 extending through both ends of the trapezium block 1' for the passage of the jaw 41 of a pair of longnose pliers 4. The rectangular opening 31 has an upper side which is parallel to the upper side of the block 1.

When in use (see FIG. 4), a jaw 41 of the longnose pliers 4 is inserted into the rectangular opening 3 (or 31) of the block 1 to keep the block 1 at a fixed position thereby enabling a screw or the like to be guided by the vertical passage between the semi-circular hole 2 and another jaw of the longnose pliers 4. Hence, the screw can be guided by the present invention to a workpiece safely, rapidly and accurately.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. In combination, a pair of pliers and a block for guiding screws and nails, the block being generally rectangular having a length, the block having a top surface, a bottom surface, two opposite lateral sides, and two opposite axial ends, each of said opposite lateral sides having a plurality of semi-circular grooves extending perpendicular to the length, and a rectangular opening extending the length of the block and through said two opposite axial ends.

2. The combination of claim 1, wherein the two opposite axial ends are each formed with an inclined surface.

3. The combination of claim 1, wherein the semi-circular grooves are of different sizes.

4. The combination of claim 1, wherein the rectangular opening has an upper side which is parallel to the top surface.

* * * * *